United States Patent [19]

Pearl

[11] 4,261,285

[45] Apr. 14, 1981

[54] APPARATUS FOR APPLYING SUBSTANCE TO SHEET MATERIAL

[75] Inventor: David R. Pearl, West Hartford, Conn.

[73] Assignee: Gerber Garment Technology, Inc., South Windsor, Conn.

[21] Appl. No.: 74,871

[22] Filed: Sep. 12, 1979

[51] Int. Cl.[3] ..... B05C 1/02

[52] U.S. Cl. ..... 118/37; 101/26

[58] Field of Search ..... 118/35, 697, 37, 243, 118/410, 76; 101/26

[56] References Cited

U.S. PATENT DOCUMENTS

| | | | |
|---|---|---|---|
| 1,771,399 | 7/1930 | Christophel, Jr. | 101/26 |
| 2,135,228 | 11/1938 | Wolkan | 101/26 |
| 2,582,854 | 1/1952 | Smith | 118/37 X |
| 2,619,031 | 11/1952 | Rothenborg | 101/26 |
| 3,731,648 | 5/1973 | Gerber et al. | 118/697 |
| 3,977,316 | 8/1976 | Okada | 101/26 |
| 4,112,531 | 9/1978 | Mitter | 101/26 X |

*Primary Examiner*—John P. McIntosh
*Attorney, Agent, or Firm*—McCormick, Paulding & Huber

[57] ABSTRACT

Apparatus for applying a substance to a layup of sheet material at a selected location on each of the sheets which comprise the layup includes a table for supporting the layup, a tool assembly including an axially elongated rotary applicator tool having a sharp free end, a carriage assembly movable relative to the supporting surface of the table for positioning the applicator tool with its free end in alignment with the selected position, a mechanism for feeding a supply of the substance to the applicator tool, a first drive mechanism for rotating the applicator tool about its axis, and a second drive mechanism for moving the applicator tool toward the layup supporting surface whereby to cause the free end of the tool to penetrate the layup and for moving the tool away from the supporting surface to withdraw it from the layup. The substance may comprise a liquid, a solid material or a paste-like substance.

8 Claims, 8 Drawing Figures

APPARATUS FOR APPLYING SUBSTANCE TO SHEET MATERIAL

BACKGROUND OF THE INVENTION

This invention relates in general to apparatus for working on a layup of sheet material and deals more particularly with an improved apparatus for applying a substance to a plurality of individual sheets of material arranged in vertically stacked relation to form a layup and at a predetermined location on each of the sheets.

In the processing of sheet material used in the production of garments, upholstery, and like products, sheet material components from which a product is made must often be marked, for various purposes. In the production of a garment, for example, the positions of buttons, buttonholes, darts and the like must be marked on component parts of the garment to facilitate subsequent garment assembly operations. To assure uniformity of the end product, it is generally desirable that the various sheets of material, or the components which are cut from these sheets, be marked, as required, in a single operation while the sheets are in layup form and before separation. Automated apparatus of the aforedescribed general type has heretofore been used for this purpose. A typical apparatus for marking a layup is illustrated and described n U.S. Pat. No. 3,731,648 to Gerber et al, assigned to the assignee of the present application, and includes an elongated hollow needed-like tool for penetrating a layup and through which fluid is ejected as the tool is withdrawn from the layup. Such apparatus may also be used to deposit adhesive at selected locations within a layup to control fraying or to temporarily adhere together the individual sheets which comprise the layup so that the layup, the individual parts cut from the layup and/or the resulting scrap material produced by the cutting operation may be handled as a unit. Such apparatus has proven generally satisfactory for processing a layup of porous fabric, or the like, which is easily penetrated by such a tool, however, a problem is encountered where the apparatus is used to process a layup of heavy fabric or dense non-porous material which offers greater resistance to tool penetration. The tool may, for example, be laterally deflected as it is pushed downwardly through the layup causing inaccurate marking and resulting in non-uniform end products. Where such material resistance is encountered the speed at which the marking operation may be performed is also substantially reduced. The present invention is concerned with aforesaid problems.

SUMMARY OF THE INVENTION

In accordance with this invention, an apparatus for applying a substance to a layup of sheet material and at a seledted location on each of the sheets which comprise the layup includes means for supporting the layup, a tool carriage assembly movable relative to the supporting means, a tool assembly mounted on the carriage assembly and including an axially elongated applicator tool extending in the direction of the layup supporting means and having a sharp free end, means for moving the carriage assembly relative to the supporting means to position the applicator tool relative to the layup, and means for moving the applicator tool toward and away from the layup supporting means to cause the tool to penetrate the layup and to withdraw the applicator tool from the layup. In accordance with the invention the applicator tool comprises a drill and the tool assembly includes a rotary spindle and means for mounting the drill on the spindle in coaxial alignment with it. A means is provided for rotating the spindle to rotate the drilling tool about its axis. The apparatus further includes means for applying the substance to the rotating drill whereby it is deposited within the layup.

DETAILED DESCRIPTION OF PREFERRESD EMBODIMENT

Figure 1:
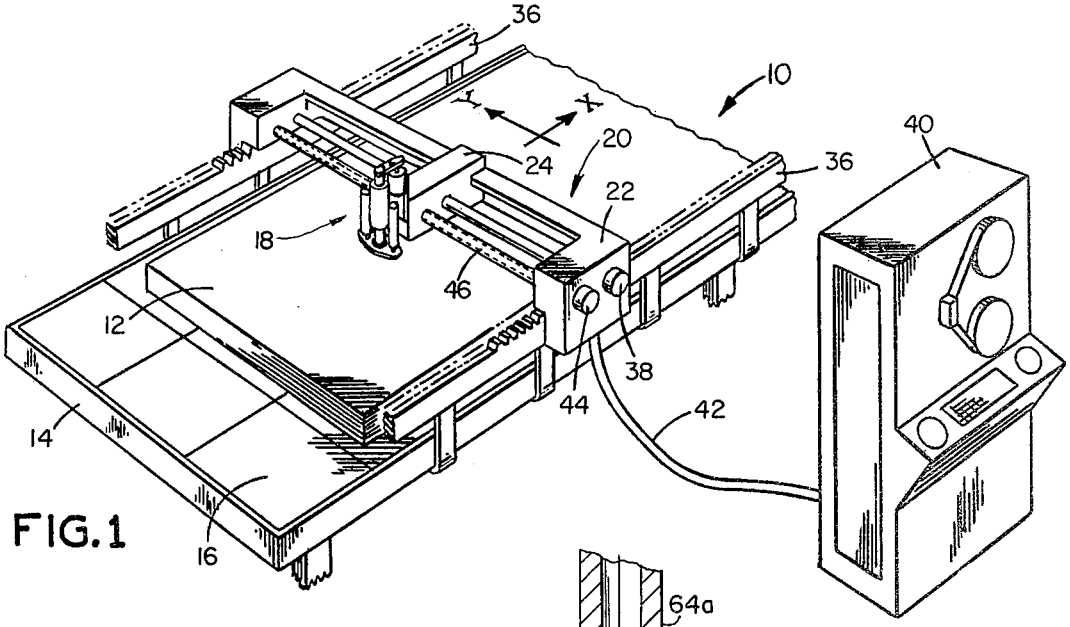
FIG. 1 is a fragmentary perspective view of an apparatus embodying the present invention.

Turning now to the drawings, a fluid applying apparatus embodying the present invention is indicated generally by the reference numeral 10 in FIG. 1. The apparatus 10 is particularly adapted to apply a marking substance, such as fluorescent dye, an adhesive, or the like at a predetermined location to each one of a plurality of sheets of material arranged in vertically stacked relation to form a layup, such as indicated at 12. The apparatus 10 includes a table 14, which has a penetrable suraface 16 for supporting a layup, and an applicator tool assembly, indicated generally at 18 and mounted on a movable carriage assembly, desiganted generally by the numeral 20. The carriage assembly 20 includes a main carriage 22 supported for movement above and relative to the surface 16 in one coordinate direction indicated by the directional arrow X. The carriage assembly further includes a tool carriage 24 supported for movement with and relative to the main carriage 22 and the table surface 16 in another coordinate direction, indicated by the arrow Y in FIG. 1.

The tool assembly 18, best shown in FIGS. 2–5, is mounted on the tool carriage 24 and includes an axially elongated drilling tool 26, a presser foot assembly, indicated generally at 28, and means for supplying marking substance or the like to the drilling tool, and designated generally by the numeral 30, (FIG. 2) all of which will be hereinafter further discussed. A drive mechanism, indicated generally at 32 and best shown in FIG. 2, rotates the drilling tool 26 about its axis. Another drive mechanism, indicated generally at 34, moves the drilling tool 26 toward the layup 12 causing it to penetrate the layup and also withdraws it from the layup, as will be further discussed.

Considering now the machine 10 in further detail, the table 14 may take various forms, but preferably, and as shown, it includes a bed of penetrable material, for example, upwardly extending bristles or penetrable plastic which defines the upwardly facing penetrable supporting surface 16. The main carriage 22 is mounted on racks 36, 36 which extend longitudinally of the table 12 along its opposite sides. A drive motor 38 drives pinions (not shown) engaged with racks 36, 36 to move the main carriage 22 longitudinally of the table or in the X-coordinate directions in response to control signals received from a programable controller 40 connected to the carriage assembly by a control cable 42. Another drive motor 44 drives a lead screw 46 in response to signals from the controller 40 to move the tool carriage 24 transversely of the table 14 or in the Y-coordinate directions whereby the drilling tool 26 may be moved to any predetermined coordinate position in axial alignment with a preselected location on the layup 12 in response to programmed signals from the controller 40.

Figure 2:
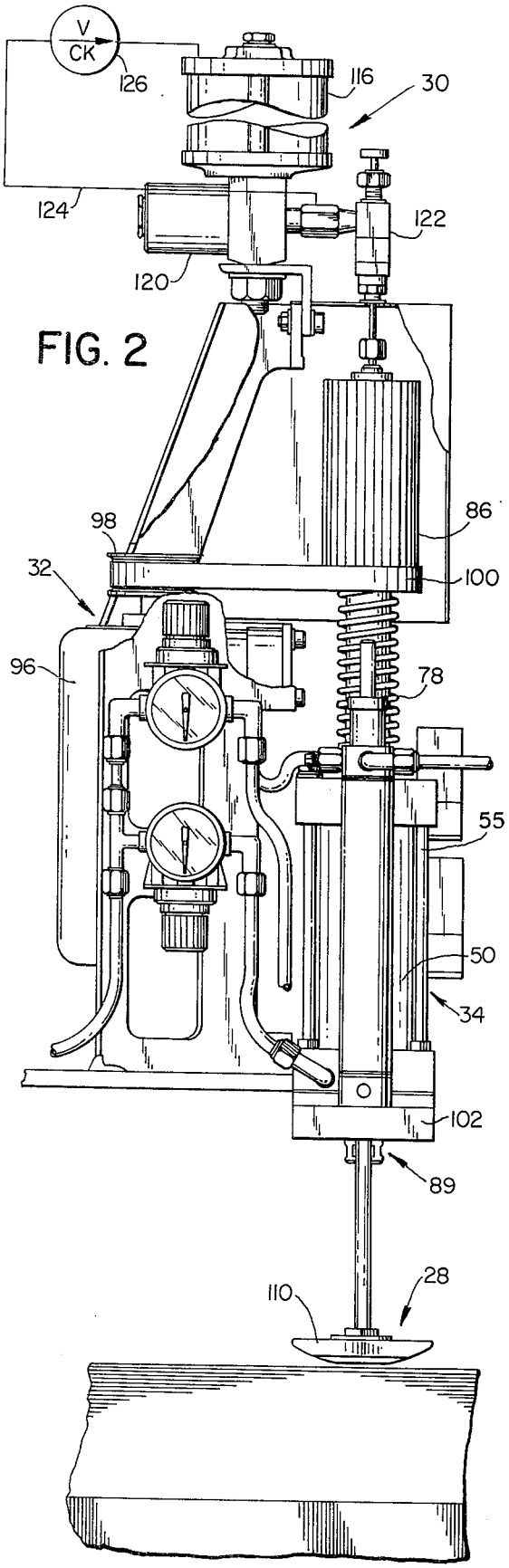
FIG. 2 is a somewhat enlarged fragmentary side elevational view showing the tool assembly which forms part of the apparatus of FIG. 1.
Figure 3:
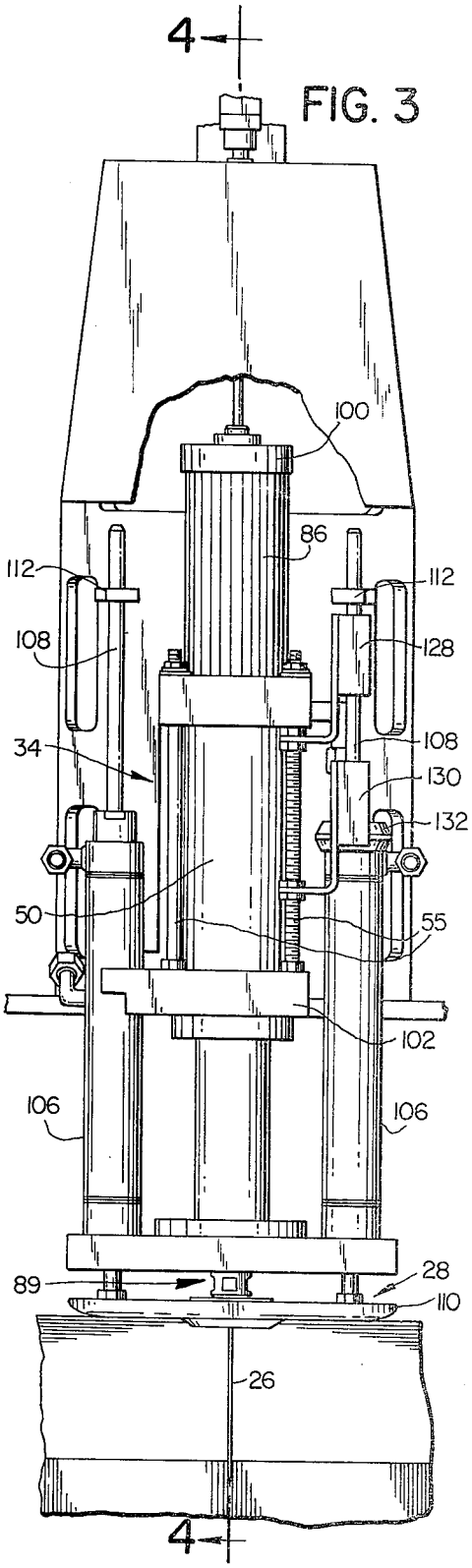
FIG. 3 is a front elevation view of the tool assembly shown in FIG. 2.
Figure 4:
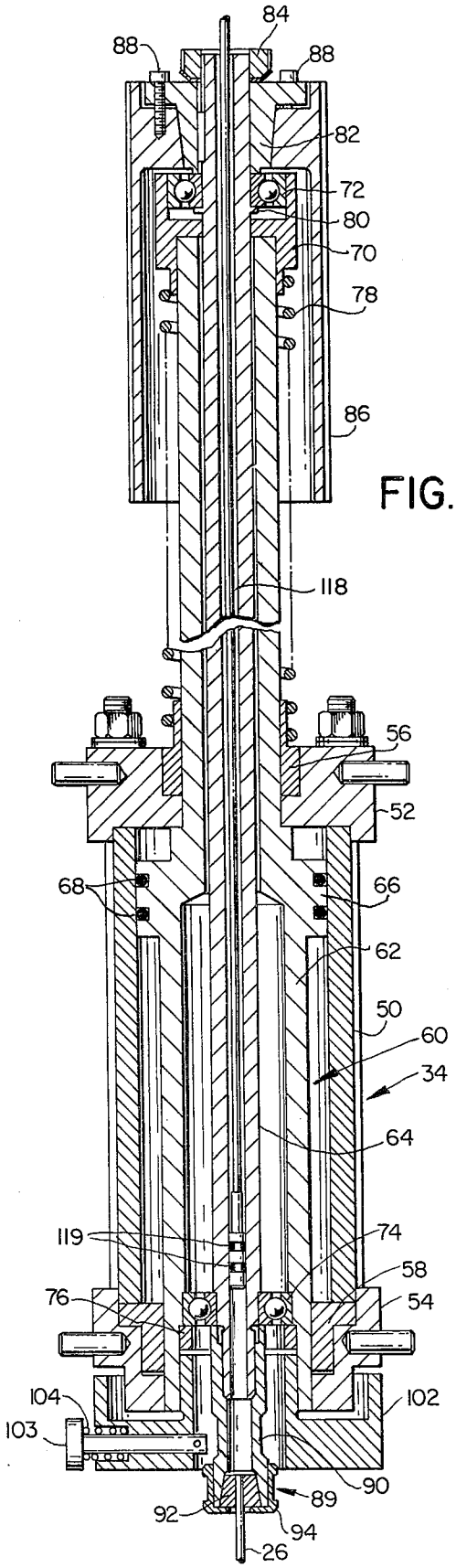
FIG. 4 is a fragmentary vertical sectional view of the tool assembly taken along the line 4—4 of FIG. 3.

Referring further to FIGS. 2–5, the tool assembly 18 is supported by a mounting bracket attached to the tool carriage 24 and includes a fluid cylinder, which comprises the drive mechanism 34, and which has a cylindrical body 50. Upper and lower end caps indicated at 52 and 54, respectively, and secured to the body 50 by threaded tie rods 55, 55 carry upper and lower guide bushings 56 and 58, as shown in FIG. 4. A drill housing assembly, indicated generally at 60 and supported by the latter bushings, includes a hollow generally cylindrical drill housing 62 and a hollow drive spindle 64. The drill housing 62 is supported in the bodt 50 for reciprocal sliding movement within the upper and lower guide bushings 56 and 58 and has a diametrically enlarged integral piston portion 66 which is disposed within the cylinder body 50 and fitted with cup seals 68, 68 substantially as shown in FIG. 4. The upper portion of the drill housing 62 is diametrically reduced and extends upwardly through the upper guide bushing for some distance above the upper end cap 52. An upper bearing cap 70 pinned to the upper end of the drill housing 62 carries an upper ball bearing 72, as shown in FIG. 2. A lower ball bearing 74 mounted in the lower end of the drill housing, bears against a downwardly facing shoulder on the housing, and is secured by a bearing retainer 76 which is threaded into the lower end of the drill housing 62 and bears against the outer race of the lower bearing 74. A compression spring 78 surrounds the upper end portion of the drill housing 62 and acts between the upper bearing cap 70 and the upper end cap 52 to bias the drill housing assembly upwardly from its lowered position of FIG. 3 to its retracted position, in which it appears in FIGS. 2 and 4.

The hollow spindle 64 is journalled for coaxial rotation within the drill housing 62 by the upper and lower bearings 72 and 74. It is retained in assembly with the drill housing by a snap ring 80, which bears upwardly against the inner race of the upper bearing 72, and by a flanged sleeve 82, which is keyed to the upper end of the spindle and bears downwardly against the inner race of the upper bearing 72. A bearing lock nut 84, threaded to the upper end of the spindle 64, cooperates with the snap ring 80 to retain the sleeve 82 in assembly with the spindle. A hollow axially elongated timing pulley 86, received on the sleeve 82, is retained for rotation with the sleeve by a plurality of fasteners 88, 88 which extend downwardly through the flanged portion of the sleeve and threadably engage the upper end of the pulley 86.

Figure 5:
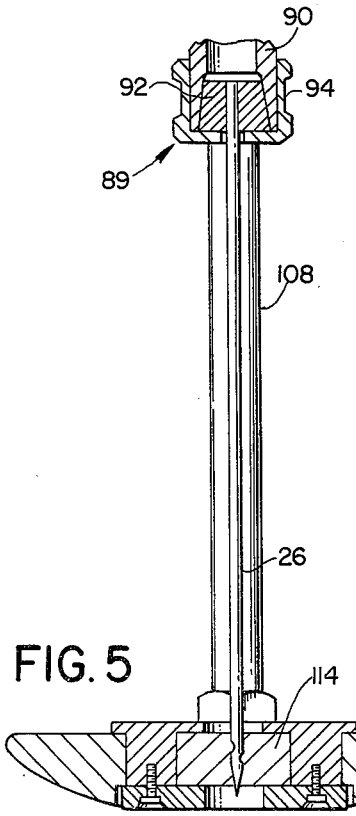
FIG. 5 is a somewhat enlarged fragmentary vertical sectional view, similar to FIG. 4, but showing the lower portion of the tool assembly.

The drilling tool 26 comprises a hollow axially elongated needle-like member sharpened at its free end and mounted in a chuck assembly, indicated generally at 89, threaded onto the lower end of the hollow spindle 64. At least one fluid outlet opens through the drilling tool near its free end and communicates with the hollow interior of the tool. The chuck assembly includes a chuck body 90 threaded onto the lower end of the spindle, a conventional collet 92 received within the chuck body, and a chuck nut 94 threaded onto the lower end of the chuck body and engaged with the collet, as shown in FIGS. 4 and 5.

Power for driving the rotary drilling tool 26 is provided by a drive motor 96 supported on the mounting bracket which secures the tool assembly 18 to the tool carriage. A flanged timing pulley 98 driven by the motor 96 is drivingly connected to the pulley 86 by a timing belt 100.

The presser foot assembly 28 is supported on the drill housing 60 and includes a presser foot support 102 which is threaded into the lower end of the drill housing below the bearing retainer 76. The support 102 has a bore coaxially aligned with the drill housing and through which the chuck body 90 extends. A detent 103 carried by the presser foot support extends through the support and is retained in assembly with the support by a rollpin at its inner end. At its inner end the detent 103 has a flat surface for engaging a flat surface on the chuck body 90. The inner end of the detend 103 is normally biased out of engagement with the chuck body by a detent spring 104 which acts between an enlarged head on the detent and the presser foot support 102.

The presser foot assembly 28 further includes a pair of fluid cylinders 106, 106 which are fastened to opposite ends of the presser foot support 102 in axially parallel alignment with the drill housing assembly 60. Each cylinder 106 includes a cylinder body which is secured to the presser foot support 102, substantially as shown in FIG. 3 and a piston rod 108 which extends upwardly through the cylinder body in axially parallel relation to the drill housing assembly 60. A presser foot 110 is fastened to the lower ends of the piston rods 108, 108, as best shown in FIG. 3. Each piston rod 108 has an adjustable clamping collar 112 secured to its upper end. The clamping collars cooperate with the bodies of the cylinders to limit downward travel of the presser foot 110. A resilient wiper 114 is mounted in the presser foot 110 in the path of the drilling tool, as best shown in FIG. 2, and receives the sharpened end of the drilling tool 26 therethrough. The wiper serves to wipe excess fluid from the drilling tool to prevent drippage.

In the illustrated apparatus 18 the means for supplying marking material to the hollow drill 26 comprises a fluid delivery system 30 which includes a fluid reservoir 116 mounted above the tool assembly. The fluid delivery system further includes an elongated member or fluid delivery tube 118 (FIG. 4) mounted in stationary position relative to the bracket which carries the tool assembly 18 and in coaxial alignment with the tubular bore of the hollow spindle shaft 64. The delivery tube extends for some distance into the latter bore and has O-rings 119 at its lower end which cooperate in sealing engagement with the bore wall. Fluid is fed from the reservoir 116 to the drilling tool 26 through a main fluid conduit system, defined, in part, by the delivery tube 118 and the drive spindle 64, which includes a solenoid valve 120 and a metering valve 122 connected in series between the reservoir and the delivery tube, substantially as shown in FIG. 2. The solenoid valve 120 has open and closed positions corresponding, respectively, to fluid flow and no flow conditions in the main flow path defined by the main fluid conduit system. A fluid return line 124 in fluid communication with the delivery tube has one end connected between the metering valve 122 and the solenoid valve 120. The other end of the fluid return line 124 is connected in fluid communication with the upper end of the reservoir 116. A check valve 126 disposed in the fluid return line 124 between the reservoir 116 and the metering valve prevents retrograde fluid flow in the return line 124.

A pair of microswitches 128 and 130 are secured to one of the cylinder tie rods 55 by jamb nuts, as shown in FIG. 3. A cam collar 132 mounted on the associated pressure cylinder 106 is disposed in the path of the actuators on the microswitches 128 and 130 to operate these microswitches in response to movement of the pressure foot assembly 28.

The carriage assembly 20 moves in response to signals received from the programmable controller 40 to position the drilling tool 26 in vertical alignment with a selected location on a layup of sheet material supported on the bed 16. When the free end of the drilling tool 26 is properly aligned and the carriage assembly has ceased to move, fluid under pressure is fed to the cylinders 50 and 106, 106 in response to further signals from the controller. The piston rods 108, 108, which carry the presser foot 110, and the drill housing assembly 62 move downwardly substantially simultaneously, although the presser foot assembly 28 may and preferably does initially lead the drill housing assembly 62 by at least a small amount. Downward movement of the presser foot assembly 28 is arrested by engagement of the presser foot 110 with the upper surface of the layup. Thereafter, the presser foot continuously exerts downward pressure on the layup to compress it in the working region immediately below the tool 26. The drill housing assembly continues to move downwardly in opposition to upward biasing force of the spring 78 in response to fluid pressure applied to the cylinder 50 above the piston portion 66 causing the drilling tool 26 to penetrate the layup. The drive spindle 64 is simultaneously rotated by the drive motor 76. The vertically elongated timing pulley 86 moves vertically relative to the timing belt 100 while the drill spindle 64 is rotating. As the rotary spindle 64 moves downwardly with the drill housing 62 and relative to the stationary fluid delivery tube a pumping action is exerted upon the fluid in the delivery system. Specifically, the downward movement of the rotaty spindle 64 relative to the lower end of the delivery tube which is sealed in engagement with the spindle bore produces a vacuum within the bore below the delivery tube causing fluid to be drawn into the lower or chuck end of the hollow rotary spindle 64. The flow of fluid into the delivery tube is, of course, controlled by the solenoid valve 120 and by the metering valve 122.

When the drilling tool 6 reaches its lowermost position, having fully penetrated the layup 12, the direction of fluid flow into the cylinder 50 is reversed. Fluid under pressure enters the cylinder from below the piston portion 66 whereas fluid in the cylinder 50 above the piston portion is exhausted, causing a return or upward movement of the drill housing assembly within the cylinder 50. The upward movement of the rotating spindle 64 relative to the stationary delivery tube causes a further pumping action whereby fluid is ejected from the fluid outlet ports near the free end of the drilling tool and into the layup. The quantity of fluid ejected in this manner may be controlled by the metering valve. Since the port openings at the lower end of the drilling tool 26 are substantially smaller than the cross-sectional area of the delivery tube there is a tendency for some of the fluid within the bore and below the delivery tube to be forced upwardly through the delivery tube 64 and through the metering valve 122 in response to the upward movement of the drill housing assembly 60. During the upward movement of the drilling tool 26 the solenoid valve 120 is normally in its closed position, however, fluid is free to flow up the delivery tube and to return to the reservoir through the return line 124 and the check valve 126. The microswitches 128 and 130 sense the position of the apparatus and more specifically, the position of the presser foot 110 and comprise a part of control system which prevents movement of the carriage assembly 20 while the drilling tool 26 is in penetrating engagement with the layup and until such time as the drilling tool has been fully withdrawn from the layup and the presser foot 110 has moved out of pressing engagement with the layup. The presser foot remains in pressing engagement with the layup 12 until the drilling tool 26 has been withdrawn from the layup and returned to its fully raised or retracted position. Thereafter, the cylinders 106, which are preferably of a single acting type, are exhausted whereby the piston rods are moved upwardly by biasing springs (not shown) contained with the cylinders 106, 106, to move the presser foot 110 out of engagement with the layup.

Figure 6:
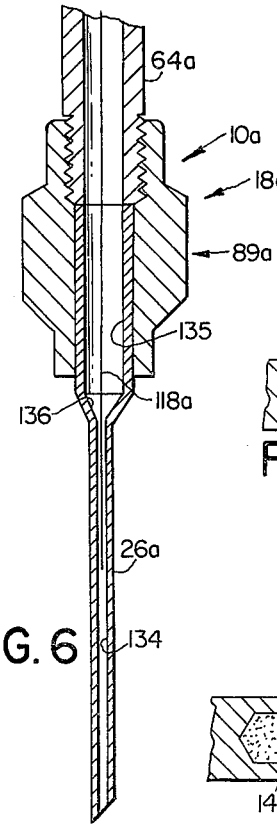
FIG. 6 is a fragmentary vertical sectional view similar to FIG. 5 showing another embodiment of the invention.

In FIG. 6 there is shown another apparatus embodying the invention and indicated generally by the reference numeral **10*a*. The apparatus 10*a* is similar in most respects to the apparatus 10 previously described but differs therefrom in the construction and arrangement of its drilling tool 26*a* and its associated fluid delivery system. Like the previously described embodiment the apparatus 10*a* includes a tubular drive spindle 64*a* which is threaded at its lower end and carries a chuck assembly indicated generally at 89*a*. The drilling tool 26*a* comprises a hollow needle-like member which is sharpened at its lower end and has a bore which includes an end portion 134, a diametrically enlarged upper portion 135 and a conical transitional portion 136 therebetween. The upper portion 134 forms a continuation of the bore in the spindle 64*a*. The spindle bore and the upper portion 134 define a reservoir for containing a quantity of dye fluid, or the like, and may be connected in communication with a somewhat larger supply reservoir or, if desired, may be manually filled. An axially elongated member or rod 118*a* is mounted in a stationary position relative to the mounting bracket which carries the ool assembly 18*a*. The lower end of the rod 118*a* extends for some distance into the bore end portion 134 when the drilling tool 26*a* is in its raised position, as it appears in FIG. 6. In the latter position the rod 118*a* substantially seals the bore 134 to prevent fluid from dripping from the lower end of the drilling tool 26*a* when it is in its raised or retracted position. When the tool 26*a* is driven to its lower position in penetrating relation to a layup, the lower end of the rod 18*a* is withdrawn from the bore end portion 134. This permits fluid to enter the bore end portion 134 from the reservoir thereabove. As the tool 26*a* is retracted from the layup it moves upwardly relative to the stationary rod 118*a* which is guided into the bore 134 by the conical transitional portion 136. Upward movement of the drilling tool 26*a* relative to the rod 118*a* causes a pumping action resulting in the ejection of fluid from the drilling tool 26a** and into the layup.

Figure 7:
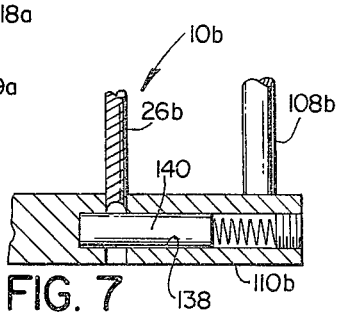
FIG. 7 is a fragmentary vertical sectional view similar to FIG. 5 illustrating still another embodiment of the invention.
Figure 8:
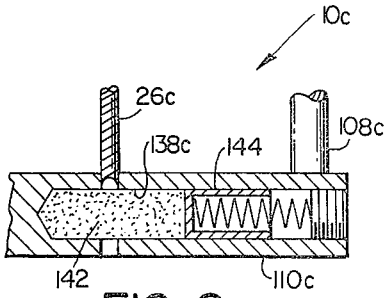
FIG. 8 is a fragmentary vertical sectional view similar to FIG. 5 showing a still further embodiment of the invention.

Referring now to FIG. 7, a further embodiment of the invention is shown and indicated generally by the reference numeral 10b. The apparatus 10b differs from the apparatus previously described in that it applies a relatively solid substance to a layup. The drilling tool 26b comprises an axially elongated solid rod-like member which is sharpened at its lower end and which preferably has at least one recess in its peripheral surface. The illustrated tool 26b has a multiplicity of recesses in its surface which may be formed by irregularities or pits or by regular grooves or flutes formed in the tool. The apparatus 10b has a presser foot assembly 28b which includes a presser foot 110b through which the drill 26b is constrained to pass. The illustrated apparatus 10b is used for marking a layup and includes a solid marking substance. The presser foot 110 comprises a means for applying the marking material to the tool 26b and has a transverse bore 138 for containing the marking material which, as shown, comprises a stick of colored wax or crayon 140. A biasing spring 142 urges the crayon 140 into the path of the tool 26b so that the tool passes through the crayon as it travels through the presser foot 110b. The crayon material which is deposited on the surface of the drilling tool or in the recesses in the tool is ultimately deposited on the individual sheets of a layup as the tool moves downwardly through the layup.

In FIG. 9 there is shown still another embodiment 10c wherein the substance to be applied to the layup comprises a sticky powder, which may, for example comprise a fluorescent dye, or a viscous liquid, such as an adhesive. The substance to be applied is indicated at 142 and contained within a bore 138c in the presser foot 110c and in the path of the drilling tool, which is indicated at 26c. The drilling tool may have a smooth or a recess surface as desired. A spring biased piston 144 disposed within the bore 138c urges the substance 142 into the path of the drilling tool 26c so that the surface of the tool is coated by the substance as the tool passes through the presser foot 110c. The tool 26c is preferably of relatively small diameter, so that the substance 142 will not be ejected or otherwise escape from the presser foot when the drilling tool is in its retracted or raised position.

I claim:

1. In an apparatus for applying fluid to a layup of sheet material formed by a plurality of individual sheets of material arranged in vertically stacked relation and at a selected location on each of the sheets wherein the apparatus includes means for supporting a layup, a tool carriage assembly, a tool assembly mounted on the carriage assembly and including an axially elongated hollow drill extending in the direction of the layup supporting means and having a sharp free end and a fluid passageway extending therethrough and terminating at a fluid outlet proximate said free end, a rotary drive spindle including a tubular member having a coaxial bore, means for mounting said drill on said drive spindle in coaxial alignment therewith, an axially elongated stationary member extending into said bore, said rotary spindle and said drill being movable relative to said stationary member, means for rotating said drive spindle about its axis, means for moving the drive spindle from a retracted position and toward the supporting means to cause the drill to penetrate a layup on the supporting means and away from the supporting means and toward its retracted position to withdraw the drill from the layup, fluid delivery means for supplying fluid to the hollow drill including a fluid reservoir, means for defining a main fluid flow path from said reservoir to said fluid passageway, and control valve means disposed in said main flow path and moveable between open and closed positions respectively corresponding to flow and no flow conditions in said main flow path for controlling flow of fluid from said reservoir to said hollow drill, and means for moving the tool carriage relative to the supporting means and for moving the tool assembly relative to the carriage assembly to position the drill with its free end in alignment with the selected location, the improvement comprising means for defining a return fluid flow path from said main path to said reservoir in by-passing relation to said control valve and at all times in fluid communication with said passageway and check valve means for permitting flow of fluid in said return flow path from said path to said reservoir and for preventing retrograde fluid flow in said return path.

2. In an apparatus as set forth in claim 1 the further improvement wherein said stationary member comprises a fluid delivery tube defining a portion of said main flow path.

3. In an apparatus as set forth in claim 2 the further improvement wherein said fluid delivery tube defines a portion of said return flow path.

4. In an apparatus as set forth in either claim 1 or claim 2 the further improvement wherein said apparatus includes metering means for regulating the flow of fluid from said main flow path to said passageway.

5. In an apparatus as set forth in claim 2 the further improvement wherein said fluid delivery system includes sealing means for effecting a seal between a portion of said delivery tube and the wall of said bore.

6. In an apparatus as set forth in claim 5 the further improvement wherein said sealing means comprises an O-ring surrounding an associated portion of said delivery tube and engaging said wall.

7. In an apparatus as set forth in claim 4 wherein said metering means also regulates the flow of fluid in said return flow path and comprises a metering valve.

8. In an apparatus as set forth in claim 7 the further improvement wherein said valve is disposed in said main flow path between said control means and said drill.

* * * * *

UNITED STATES PATENT AND TRADEMARK OFFICE

CERTIFICATE OF CORRECTION

PATENT NO. : 4,261,285

DATED : April 14, 1981

INVENTOR(S) : David R. Pearl

It is certified that error appears in the above–identified patent and that said Letters Patent are hereby corrected as shown below:

Col. 8, line 55, after "said" (first occurrence) insert --metering--.

Col. 8, line 56, after "control" insert --valve--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*